US011428182B2

(12) United States Patent
Bavois

(10) Patent No.: US 11,428,182 B2
(45) Date of Patent: Aug. 30, 2022

(54) METHOD FOR CONTROLLING A HIGH-PRESSURE FUEL INJECTOR

(71) Applicant: VITESCO TECHNOLOGIES GMBH, Hanover (DE)

(72) Inventor: Thierry Bavois, Toulouse (FR)

(73) Assignee: VITESCO TECHNOLOGIES GMBH, Hanover (DE)

( * ) Notice: Subject to any disclaimer, the term of this patent is extended or adjusted under 35 U.S.C. 154(b) by 0 days.

(21) Appl. No.: 17/424,354

(22) PCT Filed: Mar. 26, 2020

(86) PCT No.: PCT/EP2020/058579

§ 371 (c)(1),
(2) Date: Jul. 20, 2021

(87) PCT Pub. No.: WO2020/193713

PCT Pub. Date: Oct. 1, 2020

(65) Prior Publication Data

US 2022/0090553 A1 Mar. 24, 2022

(30) Foreign Application Priority Data

Mar. 26, 2019 (FR) ..... 1903119

(51) Int. Cl.
*F02D 41/20* (2006.01)
*F02M 51/06* (2006.01)
(Continued)

(52) U.S. Cl.
CPC ..... *F02D 41/20* (2013.01); *F02M 51/061* (2013.01); *F02M 61/10* (2013.01); *H01F 7/064* (2013.01); *H01F 7/081* (2013.01)

(58) Field of Classification Search
CPC ..... F02D 41/20; F02D 41/30; F02M 51/00; F02M 51/005; F02M 51/06;
(Continued)

(56) References Cited

U.S. PATENT DOCUMENTS 5,936,827 A * 8/1999 Dressler ..... F02D 41/20 361/154
6,505,609 B1 1/2003 Biester et al.
(Continued)

FOREIGN PATENT DOCUMENTS

DE 197 01 471 7/1998
DE 10 2012 218 157 4/2013

OTHER PUBLICATIONS

International Search Report for PCT/EP2020/058579 dated Jun. 4, 2020, 5 pages.
(Continued)

*Primary Examiner* — John Kwon
*Assistant Examiner* — Johnny H Hoang
(74) *Attorney, Agent, or Firm* — Nixon & Vanderhye

(57) ABSTRACT

Disclosed is a method for controlling a fuel injector provided with a solenoid for actuating a needle which opens the injector and with a spring for returning the needle to the closed position. The solenoid is supplied with power by a controller including a first potential and a second potential, a first diode and a second diode, a first transistor, a second and a third transistor which is controlled so as to generate various currents using the potentials.

4 Claims, 3 Drawing Sheets

(51) Int. Cl.
*F02M 61/10* (2006.01)
*H01F 7/06* (2006.01)
*H01F 7/08* (2006.01)

(58) Field of Classification Search
CPC ..... F02M 51/061; F02M 51/10; H01F 7/06; H01F 7/064; H01F 7/08; H01F 7/081; B05B 1/20; B05B 1/2053
USPC ..... 701/102–105; 123/470–481, 490, 495
See application file for complete search history.

(56) References Cited

U.S. PATENT DOCUMENTS

| | | | | |
|---|---|---|---|---|
| 2005/0047053 | A1* | 3/2005 | Meyer | F02D 41/20 361/139 |
| 2009/0101114 | A1* | 4/2009 | Czekala | F02P 3/0435 123/480 |
| 2011/0273812 | A1 | 11/2011 | Beer et al. | |
| 2017/0089292 | A1* | 3/2017 | Nishida | F02D 41/22 |
| 2017/0234920 | A1* | 8/2017 | Nair | F02D 41/20 361/209 |

OTHER PUBLICATIONS

Written Opinion of the ISA for PCT/EP2020/058579 dated Jun. 4, 2020, 8 pages.

* cited by examiner

[Fig. 1]
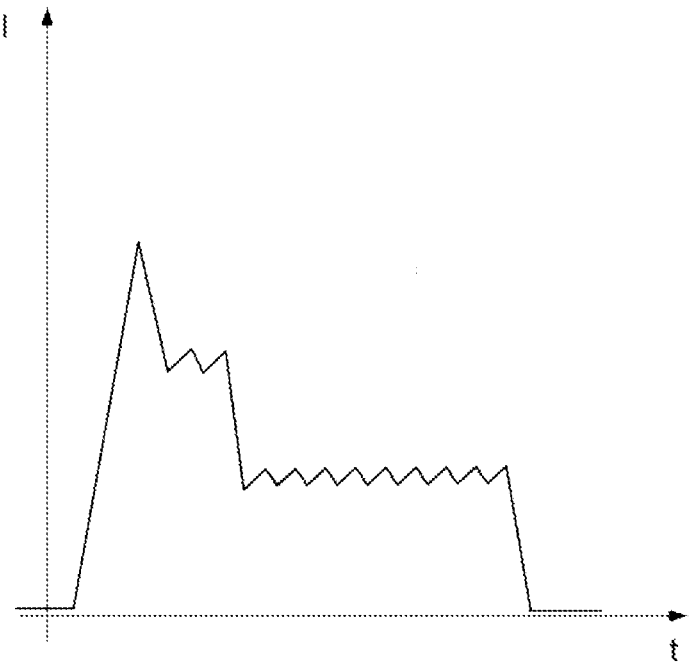
[Fig. 2]
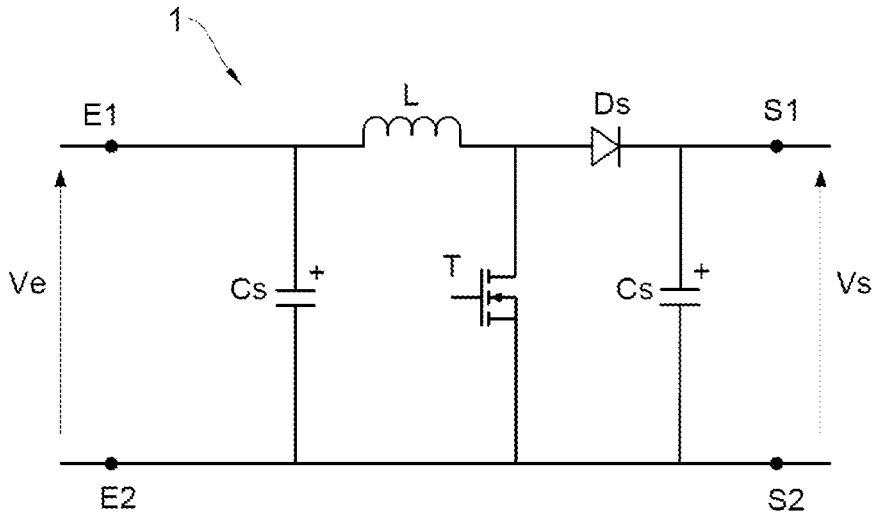

[Fig. 3]
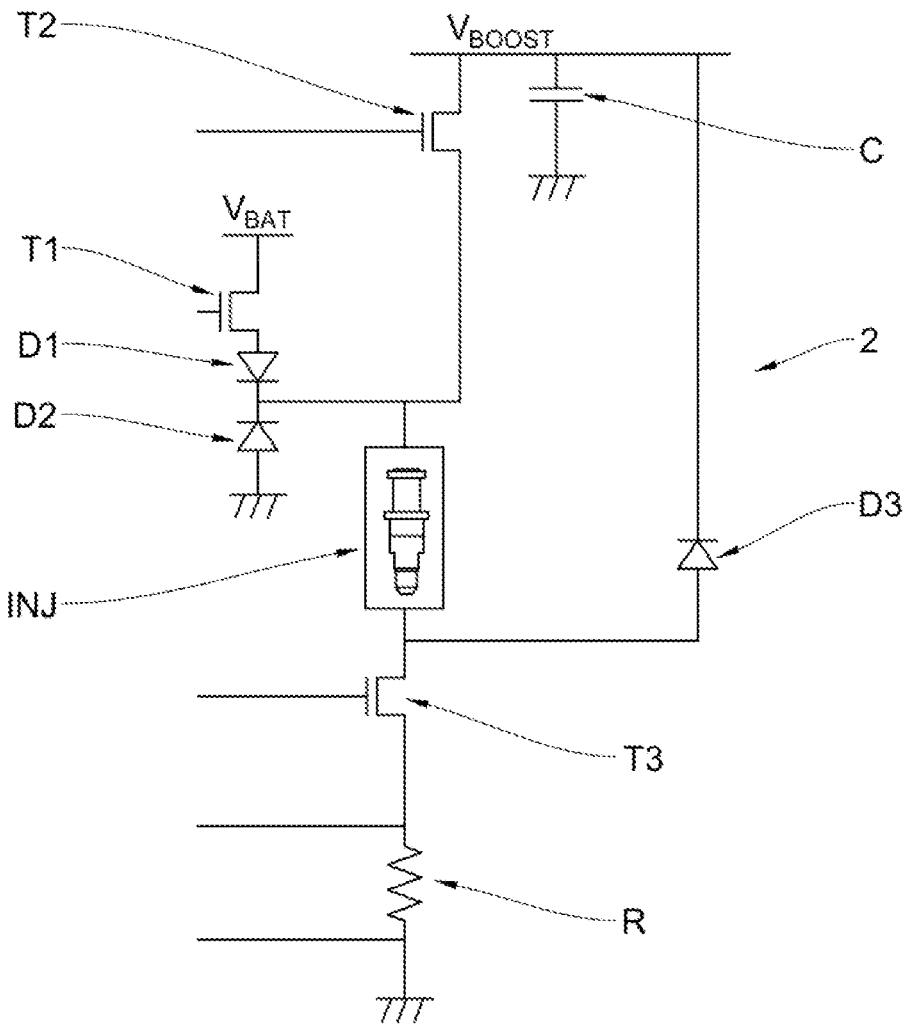

[Fig. 4]
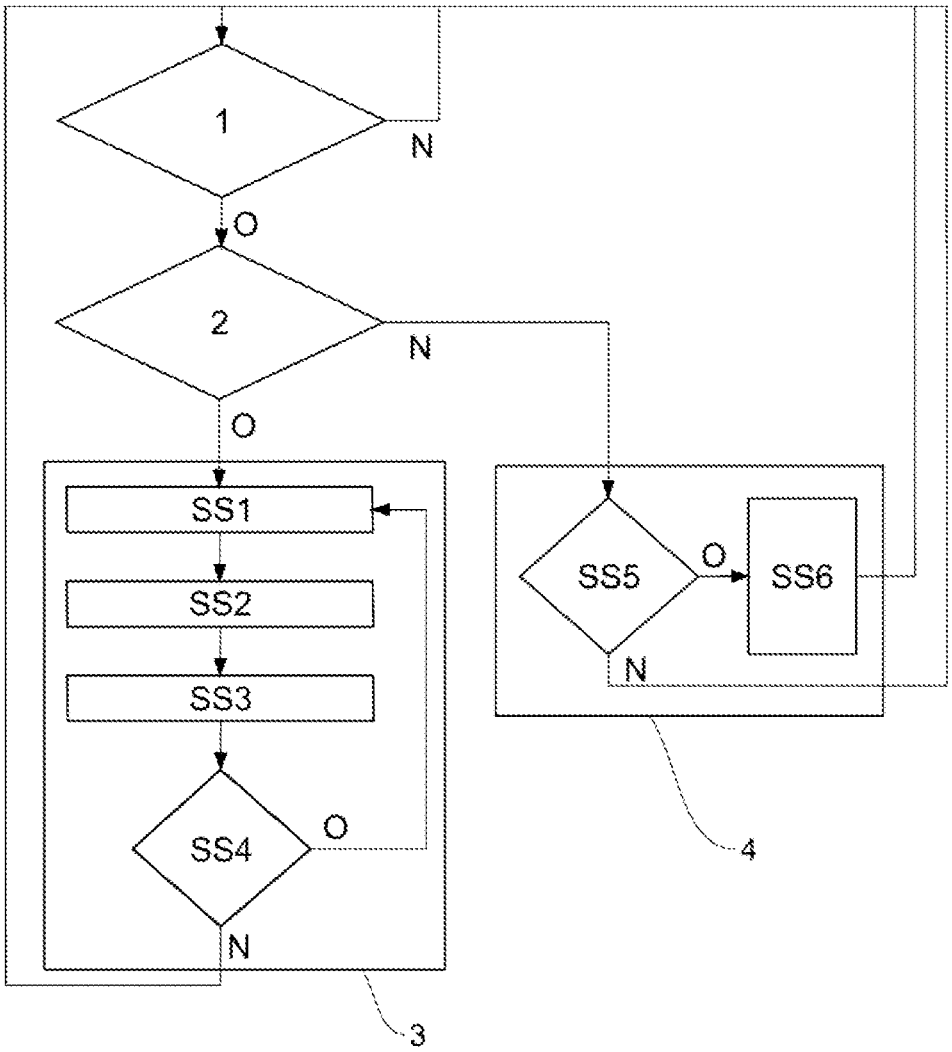

METHOD FOR CONTROLLING A HIGH-PRESSURE FUEL INJECTOR

CROSS-REFERENCE TO RELATED APPLICATIONS

This application is the U.S. national phase of International Application No. PCT/EP2020/058579 filed Mar. 26, 2020 which designated the U.S. and claims priority to French Application No. 1903119 filed Mar. 26, 2019, the entire contents of each of which are hereby incorporated by reference.

BACKGROUND OF THE INVENTION

Field of the Invention

The technical field of the invention is that of controlling high-pressure fuel injectors, and more particularly that of generating the control voltages for such injectors.

Description of the Related Art

High-pressure fuel injectors comprise a needle actuated by a solenoid and a return spring.

In order to trigger fuel injection, the needle is raised so as to open the orifice of the injector and to put an injection common rail in communication with the combustion chamber. To achieve this, a current is passed through the solenoid with sufficient strength to generate a magnetic force greater than the return force of the spring.

In order to stop the injection, the needle must be pushed back into the injector so as to close the orifice of the injector. To achieve this, the flow of current through the solenoid is interrupted. The magnetic force being interrupted, the return spring returns the needle to its rest position, closing the orifice of the injector.

Throughout the rest of the description, no distinction will be made between the solenoid of the injector and the injector in the context of power supply and control.

More precisely, a high-pressure fuel injector requires an inrush current or peak current, denoted by PEAK throughout the rest of the description, to open, allowing the needle to be raised to the open position. Once the open position has been reached, it is kept open by lower-strength currents which have a first strength and a second strength, and which are denoted by HOLD1 and HOLD2, respectively, throughout the rest of the description. FIG. 1 illustrates these different currents in a fuel injection phase.

The generation of the PEAK current involves generation of high energy. It can be obtained only using a potential Vboost obtained via a voltage step-up circuit, also known as boost circuit.

The generation of the HOLD1 and HOLD2 currents involves current regulation. Given the strength and regulation thereof, the HOLD1 and HOLD2 currents can be obtained using the battery voltage Vbat.

In the case of supplying a fuel injector with power from an automotive battery, the voltage step-up circuit required is particularly substantial and expensive.

There is a need for control for a high-pressure fuel injector that does not require a voltage step-up circuit separate from the control means in order to reduce the bulk and cost of control for a fuel injector.

No control means for a high-pressure fuel injector exist which do not require a voltage step-up circuit separate from the control means.

The technical problem identified above remains.

SUMMARY OF THE INVENTION

The subject of the invention is a method for controlling a high-pressure fuel injector for an internal combustion engine of a motor vehicle, the injector being provided with a solenoid for actuating a needle which opens the injector and with a spring for returning said needle to the closed position, the solenoid of the fuel injector being supplied with current by a control means comprising a first potential connected to the drain of a first transistor, the source of the first transistor being connected to the anode of a first diode, the cathode of the first diode being connected to the cathode of a second diode, to a first connector of the solenoid of the injector and to the source of a second power transistor, the drain of the second transistor being connected to a second potential, the anode of the second diode being connected to ground, the second potential being connected to ground via a capacitance, to the cathode of a third diode, and to the drain of the second transistor, the anode of the third diode being connected to a second connector of the solenoid of the injector and to the drain of a third transistor, the source of the third transistor being connected to ground via a resistor.

The control method comprises the following steps:

- it is determined whether the second potential is lower than the potential threshold allowing a current for opening the needle of the injector to be generated,
- if this is the case, it is determined whether an injection is not required,
- if this is the case, the solenoid of the injector is charged by controlling the first transistor and the third transistor so as to be on while controlling the second transistor so as to be off, and then, after detecting an inductance charging current greater than a reference current through the resistor, the transistors are controlled so as to be in a second state in which the first transistor is controlled so as to be on while controlling the second transistor and the third transistor so as to be off,
- a predetermined time is waited to allow the solenoid to discharge,
- it is determined whether the second potential is lower than the potential threshold allowing a current for opening the needle of the injector to be generated,
- if this is the case, the method returns to charging the solenoid of the injector.

When it has been determined that an injection is required, the following steps may be carried out:

- it is determined whether regulation of the current flowing through the solenoid of the injector is under way,
- if this is the case, when a decrease in the regulated current is required, the first transistor is controlled so as to be on, while controlling the second transistor and the third transistor so as to be off.

The reference current may be equal to a current that makes it possible not to actuate the injector outside the injection phases.

BRIEF DESCRIPTION OF THE DRAWINGS

Further aims, features and advantages of the invention will become apparent from reading the following description, given solely by way of non-limiting example, and with reference to the appended drawings, in which:

FIG. 1 illustrates the main changes in the current flowing through the solenoid of the injector during an injection, FIG. 2 illustrates the main elements of a voltage step-up circuit, FIG. 3 illustrates the main elements of a means for controlling an injector, and FIG. 4 illustrates the main steps of a method for controlling an injector.

DESCRIPTION OF THE PREFERRED EMBODIMENTS

FIG. 2 illustrates a voltage step-up circuit used to generate the potential Vboost.

The voltage step-up circuit 1 comprises a first input E1, a second input E2, a first output S1 and a second output S2.

One plate of an input capacitor Ce is connected between the first input E1 and the second input E2. The other plate of the input capacitor Ce is connected to the second input E2.

An inductance L is connected by one of its ends to the first input E1, and by its other end to the anode of a diode D and to the drain of a power transistor T, in particular a MOSFET (metal-oxide-semiconductor field-effect transistor, an insulated-gate field-effect transistor). The source of the transistor T is connected to the second input E2.

The cathode of the diode D is connected to the first output S1 and to one plate of an output capacitor Cs. The other plate of the output capacitor Cs is connected to the second output S2.

Lastly, the second input E2 and the second output S2 are connected together and to ground.

An input voltage Ve is applied between the two inputs E1, E2, while the transistor T is controlled so as to close. The voltage across the terminals of the inductance L is then equal to Ve such that the inductance is charged with energy.

When the transistor T is controlled so as to open, the inductance L is discharged toward the two outputs S1, S2 with an output voltage Vs higher than the input voltage Ve.

It should be noted that the output capacitor Cs is charged during the discharging of the inductance L. The output capacitor Cs is then discharged when a current is drawn at output. The diode D makes it possible to prevent the capacitor from being discharged into the switch during the charging of the inductance. The output capacitor Cs thus makes it possible to smooth the output voltage.

The input capacitor Ce makes it possible to smooth any variations in input voltage.

The transistor T is switched fast enough to be able to quickly charge the capacitance at output in order to supply current to a load.

In FIG. 3, the structure of a means 2 for controlling a high-pressure fuel injector can be seen.

The control means comprises a first potential Vbat, generally connected to the battery. The first potential Vbat is connected to the drain of a first power transistor T1. The source of the first power transistor T1 is connected to the anode of a first diode D1. The cathode of the first diode D1 is connected to the cathode of a second diode D2, to a first connector of the injector INJ, and to the source of a second power transistor T2. The drain of the second power transistor T2 is connected to a second potential Vboost. The second potential Vboost is generally connected to a voltage step-up circuit 1 as illustrated in FIG. 2.

The anode of the second diode D2 is connected to ground.

The second potential Vboost is connected to ground via a capacitance C.

The second potential Vboost is also connected to the cathode of a third diode D3, the anode of the third diode D3 being connected to a second connector of the injector INJ and to the drain of a third power transistor T3. The source of the third power transistor T3 is connected to ground via a resistor R.

The control means also comprises a means for measuring the second potential Vboost and a means for measuring the current flowing through the resistor R.

Controlling the three transistors T1, T2, T3 makes it possible to generate and regulate the various currents supplying the injector INJ with power.

In particular, if the first transistor T1 is controlled so as to be off while the second transistor T2 and the third transistor T3 are controlled so as to be on, a current flows from the second potential Vboost through the injector INJ and the resistor R to ground.

The current obtained then corresponds to the PEAK current. The generation of such a current removes or greatly reduces a large portion of the second potential Vboost. It is then necessary to raise the potential of the second potential Vboost back up to a predetermined level allowing the PEAK current to be generated.

If the first transistor T1 and the second transistor T2 are controlled so as to be off while the third transistor T3 is controlled so as to be on, a current flows through the second diode D2, the injector INJ and the resistor R to ground.

The strength of the current flowing through the injector INJ then decreases to the HOLD1 current which is then regulated.

A similar mechanism is employed to regulate the strength when going from a HOLD1 current to a HOLD2 current, which is then regulated.

If the first transistor T1 and the third transistor T3 are controlled so as to be on while the second transistor T2 is controlled so as to be off, a current flows from the first potential Vbat through the first diode D1, the injector INJ and the resistor R to ground.

The strength of the current flowing in the injector INJ then increases to the HOLD1 current. A new phase for decreasing the current is then initiated as described above.

A similar mechanism is employed to increase strength when regulating the strength of the current so as to be around a specified value, for example around HOLD2.

If the first transistor T1, the second transistor T2 and the third transistor T3 are controlled so as to be off, a current flows through the second diode D2, the injector INJ, the third diode D3, the second potential Vboost, and the capacitor C to ground.

The strength of the current flowing through the injector INJ then decreases rapidly, making it possible to reach zero strength and to cut the opening of the injector and go from the HOLD2 current to zero strength.

The inventor noticed that the structure of the control means for the injector comprised elements in common with the structure of a voltage step-up circuit as illustrated in FIG. 2.

It may thus be seen that the transistor T of FIG. 2 corresponds to the third transistor T3 of FIG. 3, the diode D of FIG. 2 to the third diode D3 of FIG. 3 and the inductance L to the solenoid of the injector INJ through which the current flows. The first transistor T1 is controlled so as to be on and the second transistor T2 is then controlled so as to be off.

The control means may thus be used to raise the second potential Vboost up to the potential required to obtain the PEAK current in a manner similar to a separate voltage step-up circuit, when the inductance is charged.

The charging of the inductance of the injector may be achieved by way of the expected operation of the control means, in particular by controlling the first transistor T1 and the third transistor T3 so as to be on, while controlling the second transistor T2 so as to be off.

The inductance of the injector INJ is discharged by controlling the first transistor T1 so as to be on while the second transistor T2 and the third transistor T3 are controlled so as to be off.

The control means for the injector exchanges instructions for switching the transistors T1, T2, T3 with an electronic control unit and transmits values of the measured currents and potentials. The electronic control unit is thus able to determine the current injector control phase, according to the instructions received from engine control and in conjunction with the change in the current flowing through the injector illustrated in FIG. 1.

The method for controlling the injector thus applies to the means for controlling the injector and to its electronic control unit.

In FIG. 4, it can be seen that the method for controlling the injector comprises a first step STEP1 during which the value of the second potential is determined, and then it is determined whether the second potential Vboost is lower than a predetermined potential threshold, allowing a PEAK current for opening the needle of the injector to be generated.

If this is not the case, the second potential is already at the level required to generate the PEAK current. The method then returns to the first step STEP1.

If this is the case, the method continues on to a second step STEP2 during which it is determined that an injection is not required.

If this is the case, the method continues on to a third step STEP3 during which the transistors are controlled first so as to be in a first state of the control means in which the first transistor T1 and the third transistor T3 are controlled so as to be on and the second transistor T2 is controlled so as to be off in a first sub-step SS1 and then, after detecting an inductance charging current greater than a reference current through the resistor R, the transistors are controlled so as to be in a second state in which the first transistor T1 is controlled so as to be on and the second transistor T2 and the third transistor T3 are controlled so as to be off, in a second sub-step SS2. The method then returns to the first step STEP1.

In the first state, the inductance of the injector is charged with a reference current smaller than the activation current for the injector supplied by the first potential Vbat.

In the second state, the inductance of the injector is discharged into the second potential Vboost in a manner similar to the discharging of a voltage step-up circuit.

During a third sub-step SS3, a predetermined time is waited to allow the solenoid to discharge. It should be noted that the waiting time is equal to a fixed value allowing a frequency equivalent to the frequency of a boost circuit to be defined.

During a fourth sub-step SS4, it is determined whether the second potential is lower than the potential threshold allowing a current for opening the needle of the injector to be generated, if this is the case, the method returns to charging the solenoid of the injector in step SS1.

If this is not the case, the method returns to step STEP1.

If, in the second step STEP2, it has been determined that an injection is required, the method continues on to a fourth step STEP4, during which, in a third sub-step SS5, it is determined whether regulation of the current flowing through the injector is under way.

If this is not the case, the method returns to the first step STEP1.

If this is the case, it is determined when a decrease in the regulated current is required during a fourth sub-step SS6. When this is the case, the first transistor T1 is controlled so as to be on, and the second transistor T2 and the third transistor T3 are controlled so as to be off. The method then returns to the first step STEP1.

Once the current flowing through the injector is being regulated, it is then possible to recover any decreases in injector current due to regulation, so as to raise the second potential back up to the predetermined value in a manner similar to a voltage step-up circuit.

The control method makes it possible to use the components of the control means to form a voltage step-up circuit in order to increase the second potential. If an injection is under way, there is reuse of the energy that has to be extracted from the injector during the discharges of current in order to regulate the current thereof so as to be at a setpoint value, in particular HOLD1 and HOLD2. If no injection is required, the control means is controlled so as to charge the inductance of the injector with a current smaller than the activation current for the injector so as to be able to subsequently discharge it to the second potential in the form of a voltage step-up circuit.

Thus, the structure of the control means may be used in all injector operating phases without impairing the operation thereof.

The invention claimed is:

1. A method for controlling a high-pressure fuel injector for an internal combustion engine of a motor vehicle, the fuel injector being provided with a solenoid configured to actuate a needle which opens the injector and a spring configured to return said needle to a closed position, the solenoid of the fuel injector being supplied with a current by a control circuit including a first voltage source, a second voltage source, a first transistor, a second transistor, a third transistor, a first diode, a second diode, and a third diode, a drain of the first transistor connected to the first voltage source, a source of the first transistor being connected to an anode of the first diode, a cathode of the first diode being connected to: (i) a cathode of a second diode, (ii) a first connector of the solenoid of the injector, and (iii) a source of the second transistor, a drain of the second transistor being connected to the second voltage source, an anode of the second diode being connected to ground, the second voltage source being connected to: (i) ground via a capacitance, (ii) a cathode of the third diode, and (iii) the drain of the second transistor, an anode of the third diode being connected to a second connector of the solenoid of the injector and to a drain of a third transistor, a source of the third transistor being connected to ground via a resistor, the control method comprising:

measuring a voltage of the second voltage source;

determining whether the measured voltage of the second voltage source is lower than a voltage threshold allowing the current to open the needle of the fuel injector;

when the measured voltage of the second voltage source is determined to be lower than the voltage threshold, determining whether the injection is not required;

when the injection is not required, in a first state, charging the solenoid of the injector by controlling the first transistor and the third transistor to be on while controlling the second transistor to be off, and in a second state, after detecting an inductance charging current greater than a reference current through the resistor, controlling the first transistor to be on while the second transistor and the third transistor are controlled to be off;

waiting a predetermined time to allow the solenoid to discharge;

determining whether the voltage of the second voltage source is lower than the voltage threshold allowing the current to open the needle of the fuel injector; and when the voltage of the second voltage source is lower than the voltage threshold, returning to charging the solenoid of the fuel injector.

2. The control method as claimed in claim 1, wherein, when it has been determined that the injection is required, determining whether regulation of the current flowing through the solenoid of the injector is under way, and when regulation of the current flowing through the solenoid of the injector is under way, when a decrease in the regulated current is required, controlling the first transistor to be on while controlling the second transistor and the third transistor to be off.

3. The control method as claimed in claim 1, wherein the reference current is equal to a current that makes it possible not to actuate the injector outside injection phases.

4. The control method as claimed in claim 2, wherein the reference current is equal to a current that makes it possible not to actuate the injector outside injection phases.

* * * * *